US005279445A

United States Patent [19]

Fisher et al.

[11] Patent Number: 5,279,445

[45] Date of Patent: * Jan. 18, 1994

[54] CABLE OPERATED ICE DISPENSING DOOR

[75] Inventors: Charles Fisher, Louisville, Ky.; Jerry L. Landers, Sellersburg, Ind.

[73] Assignee: SerVend International, Inc., Sellersburg, Ind.

[ * ] Notice: The portion of the term of this patent subsequent to Jan. 1, 2008 has been disclaimed.

[21] Appl. No.: 912,693

[22] Filed: Jul. 13, 1992

Related U.S. Application Data

[60] Division of Ser. No. 577,580, Sep. 5, 1990, Pat. No. 5,129,547, which is a continuation-in-part of Ser. No. 218,864, Jul. 14, 1988, Pat. No. 4,981,237.

[51] Int. Cl.[5] ..... B67D 1/16; B67D 5/62

[52] U.S. Cl. ..... 222/1; 222/108; 222/146.6; 222/504; 62/344

[58] Field of Search ..... 222/1, 108, 146.6, 504, 222/556, 517, 146.1, 109, 110; 62/344

[56] References Cited

U.S. PATENT DOCUMENTS 566,143 8/1896 Cromwell et al. .
1,290,090 1/1919 Cole .
1,613,831 1/1927 Huntington et al. .
2,526,949 10/1950 Hull .
2,586,588 2/1952 Weseman et al. .
2,692,705 10/1954 Marihart .
2,694,509 11/1954 Vita .
2,791,887 5/1957 Hennig .
2,804,996 9/1957 Werner et al. .
2,927,440 3/1960 Kohl .
3,021,035 2/1962 Hill .
3,074,599 1/1963 Fox .
3,207,366 9/1965 Feistel, Jr. .
3,211,338 10/1965 Weil et al. .
3,272,300 9/1966 Hoenisch .
3,341,065 9/1967 Schuldt et al. .
3,348,656 10/1967 Hall et al. .
3,580,428 5/1971 Garber .
3,592,366 7/1971 Markley .
3,605,430 9/1971 Conti .
3,640,088 2/1972 Jacobus et al. .
3,719,307 3/1973 Larson .
3,798,923 3/1974 Pink et al. .
3,858,765 1/1975 Landers .
3,874,559 4/1975 Pink .
3,881,642 5/1975 Hoenisch .
3,902,331 9/1975 True, Jr. et al. .
3,913,343 10/1975 Rowland et al. .
3,916,949 11/1975 Armstrong ..... 222/556 X
3,918,266 11/1975 Gindy et al. .
4,049,161 9/1977 Kohl .
4,084,725 4/1978 Buchser .
4,089,436 5/1978 Marks .
4,090,641 5/1978 Lindenschmidt .
4,123,918 11/1978 Kohl et al. .
4,139,126 2/1979 Krasner et al. .
4,189,063 2/1979 Matthiesen .
4,220,266 9/1980 Braden et al. .
4,227,383 10/1980 Horvay .
4,228,923 10/1980 Barnard .
4,252,002 2/1981 Mullins, Jr. .
4,254,896 3/1981 Stanford et al. .
4,276,750 7/1981 Kawasumi .
4,346,824 8/1982 Miller et al. .
4,423,830 1/1984 Lents et al. .
4,470,522 9/1984 Lents et al. .
4,498,607 2/1985 Jaschinski .
4,512,502 4/1985 Landers .
4,555,049 11/1985 Mawby et al. .
4,641,763 2/1987 Landers et al. .
4,676,405 6/1987 Lents et al. .
4,679,715 7/1987 Hovinga .
4,694,661 9/1987 Landers .
4,787,539 11/1988 Uchida et al. .
4,803,850 2/1989 Josten et al. .
4,930,685 6/1990 Landers .
4,981,237 1/1991 Landers ..... 222/146.6 X
5,129,547 7/1992 Fisher et al. ..... 222/504 X

*Primary Examiner*—Kevin P. Shaver
*Attorney, Agent, or Firm*—James Creighton Wray

[57] ABSTRACT

An ice dispensing apparatus having a storage bin with a paddle wheel which moves the ice from a storage bin to a delivery chute. A straight door is utilized to selectively open and close the delivery chute. A drip pan is provided on the outside of the chute to collect the melt water from the ice, which is in the delivery chute.

27 Claims, 4 Drawing Sheets

FIG. 3
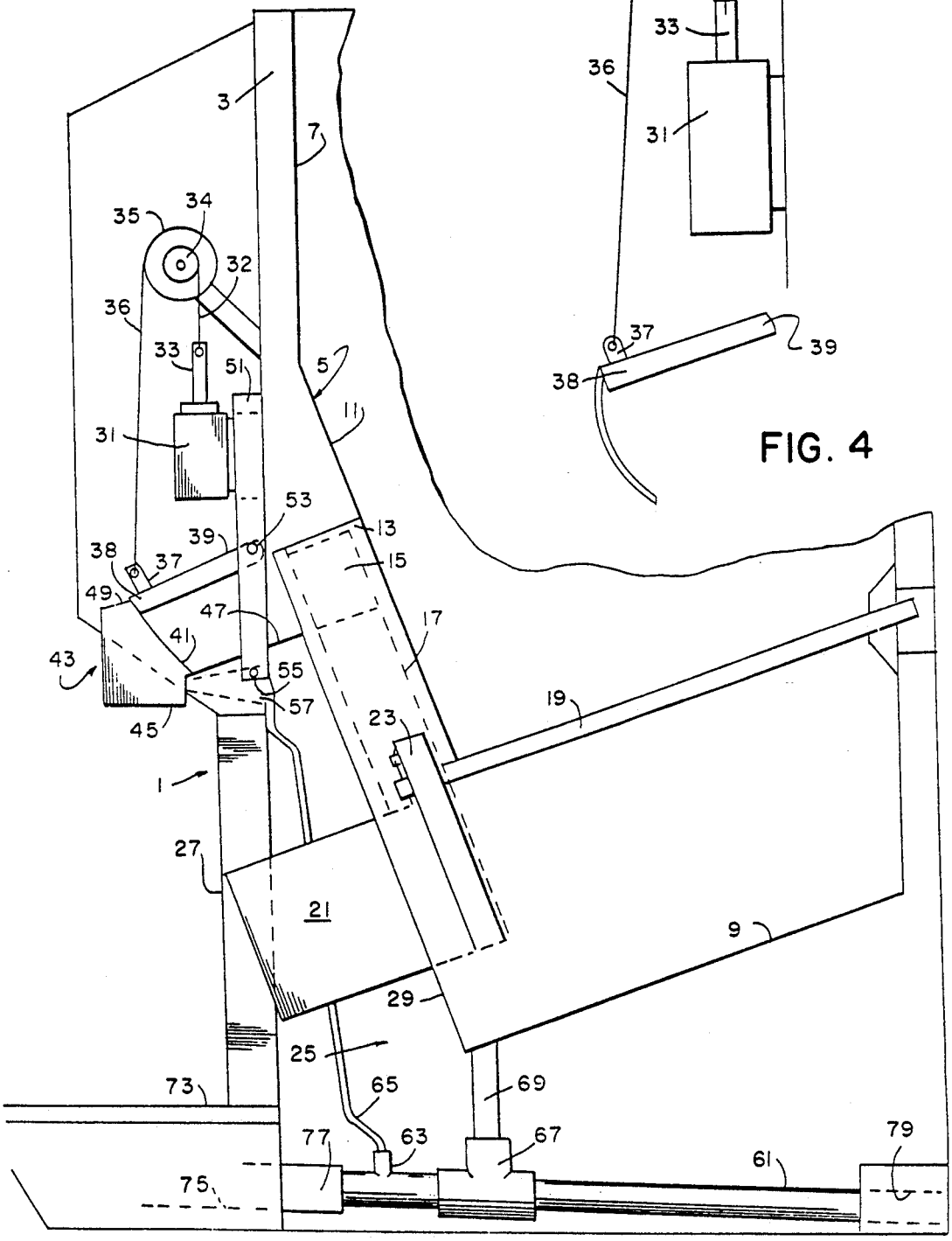
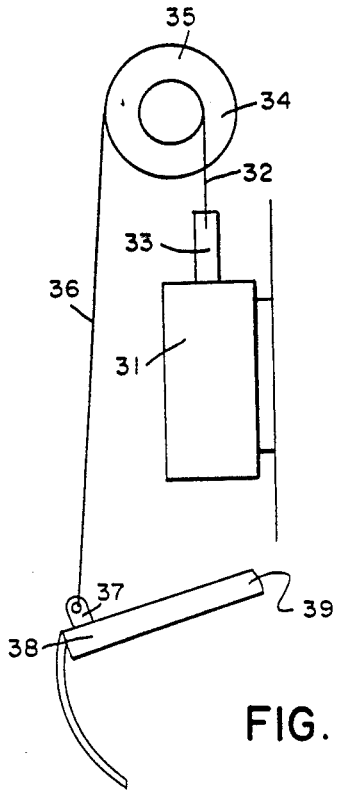
FIG. 4

CABLE OPERATED ICE DISPENSING DOOR

This is a division of application Ser. No. 577,580 filed Sep. 5, 1990, now U.S. Pat. No. 5,129,547, which is a continuation-in-part of application Ser. No. 218,864 filed Jul. 14, 1988, now U.S. Pat. No. 4,981,237.

BACKGROUND OF THE INVENTION

A problem of long standing in the ice dispensing field is ice spillage due to run over. The problem is universally recognized by persons adding ice to containers through automatic dispensing machines.

Usually when adding ice to a container before filling it with soft drink at a convenience store the container is pushed against a wire, lever, plate or button which starts the ice dispensing. Ice falls into the cup from a chute above the cup. When the desired amount of ice is obtained, the container is moved away from the wire, lever, plate or button. Ice continues to fall from the chute as the container is pulled away, dropping ice onto the pan beneath the chute. The long-standing problem wastes ice, causes more ice than desired to flow into the container, or requires special practice in partially withdrawing the container to release the switch before the desired amount of ice falls into the container and holding the container under the chute with the switch deactivated until the ice stops falling. The general problem is known in the field as ice spillage. The problem exists in filling cups with ice and in filling other containers such as ice buckets and bags from large dispensers of ice.

The problem has long existed without solution.

Other problems deal with the use of a solenoid door. One of the problems with a solenoid door is the binding or jamming of the solenoid piston. This situation is usually caused by lateral loading of the piston. The lateral loading of the piston usually causes binding and excessive wear, which leads to service calls or short solenoid life.

Another problem with choosing a solenoid is its pull strength.

SUMMARY OF THE INVENTION

The present invention recognizes that the problem associated with spillage is really three major problems. One of the problems if the speed at which a door closes. If a door closes too slowly, the ice continues to flow during the closing.

A second problem is bad door design. A third problem is in-flight ice.

In-flight ice is the ice suspended in midair that finds itself between the door and the cup when a customer decides that he has enough ice. The door closes, the cup is full or is pulled away from the switch, and the in-flight ice spills into the drain pan. The present invention solves the three problems by providing a new, rapidly acting door and by providing the door as close as possible to the cup. When the door closes, the present invention has only one or two cubes of ice in flight. If the cup has not intentionally been filled to overflowing, those one or two cubes will drop into the cup before it can be fully withdrawn from beneath the chute.

The solving of the pre-existing problems by moving the door close to the cup creates a different problem. Ice housed behind the door waiting to be dispensed is now outboard of the insulated ice bin. That ice may start to melt before the next opening of the door and dripping may occur from the delivery chute.

The present invention solves that additional problem by providing a drip pan immediately beneath the door and draining water from the door drip pan to the main drain.

The present invention solves the problems of using a solenoid with embodiments of the present invention using a cable operated door mechanism.

In a preferred ice dispensing apparatus, ice is stored in an insulated ice storage means. Motive means moves ice from the storage means to the delivery chute. A door means is connected just above the delivery chute for controlling flow of ice out of the delivery chute.

In one embodiment of the invention, a door operator is a solenoid mounted above the delivery chute. The solenoid has a movable armature. An extension on the movable armature extends toward the delivery chute. A link is connected to an end of the extension distally from the solenoid. A door mounting plate has proximal and distal ends. A pivot means for connecting the proximal end of the door mounting plate. A lug is connected to the door mounting plate near the proximal end and is connected to the link means for moving the door mounting plate with the link, extension and armature. A door is connected to a distal end of the door mounting plate and extends downward therefrom into a selective blocking arrangement with respect to the chute. The door is movable with the plate from a chute blocking condition to a chute opening condition.

In another embodiment, the door operator is a solenoid mounted above the delivery chute, but with a movable armature extending away from the delivery chute, which is connected to a first cable extending upward. This first cable is connected to a first pulley. This first pulley is joined to a second pulley. A second cable extends downward from this second pulley toward the delivery chute. The door mounting plate is provided with proximal and distal ends. A pivot means for connecting the proximal end of the door mounting plate. A lug is connected to the door mounting plate near the distal end to which is connected the second cable for moving the door mounting plate in connection with the first pulley, first cable and armature. The door connected to the distal end of the door mounting plate and extends downward from the door mounting plate into a selective blocking arrangement with respect to the chute. The door is again movable with the plate from the chute blocking condition to a chute opening condition.

Preferably, the lug which is connected to the door mounting plate is connected at the distal end of the door mounting plate and extends slightly beyond the door mounting plate.

In one embodiment, the door has a curvature centered on the pivot means. A curved surface of the door moves within a circular arc about the pivot means in response to movements of the armature.

Preferably, the door has a straight shape and moves within a circular arc about the pivot means in response to movements of the armature.

Preferably, a drip collector means is connected to the ice storage means on a side of the door remote from the ice storage means. Melt water from ice held in the chute by the door is collected by the drip collector.

In one embodiment, the drip collector has a ledge connected to a bottom of the chute external of the door and lower than the door. A collection pan is mounted beneath the ledge. The ledge drips water from melting ice held behind the door, and the collection pan collects water dripping from the ledge. A conduit is connected to the pan and to a drain for draining water from the pan.

In the preferred embodiment, the drip collector consists of a collection pan which is mounted beneath the chute to an outside wall of the insulated storage means. The water from melting ice held behind the door drips into the collection pan. A conduit is connected to the pan and to a drain for draining the water from the pan.

In one embodiment, the apparatus has a frame mounted on the ice storage means adjacent the chute. The frame extends vertically above and below the chute. The drip collection pan is connected to a lower end of the frame. The vertically extending frame is mounted on the ice storage means adjacent the chute. The door has a door support having distal and proximal ends. A pivot means connects a proximal end of the door support to a medial portion of the frame and the solenoid is connected to an upper portion of the frame. A door plate extends into the chute from the distal end of the door support, and an actuator moves the door support.

In the preferred embodiment, the door has a door support having distal and proximal ends. The pivot means connects the proximal end of the door support to an outer wall of the ice storage means. The solenoid is also connected to this outer wall of the ice storage means in a position adjacent to the pivot means. A door plate extends from the distal end of the door support, and an actuator moves the door support.

In one embodiment, the actuator is a solenoid connected to an upper portion of the frame. An armature extends downward from the solenoid. A first end of a link is connected to a lower end of the armature. A lug is connected to the door support and to the second end of the link. The lug is mounted on the door support at a position closer to the proximal end than to the distal end. The door moves at a speed greater than the armature and over a distance greater than the armature.

Alternatively, the armature extends upward from the solenoid. A first cable is attached to this armature and extends upward, where it is attached to a first pulley. This first pulley is attached to a companion pulley. A lug is connected to the door support. This lug is mounted on the door support at a position closer to the distal end than the proximal end. A second cable is connected between the lug and the second pulley.

In the preferred embodiment, the lug is mounted at the distal end of the door support and extends beyond the door support.

In this preferred embodiment, the second pulley is larger than the first pulley.

A preferred ice dispenser discharge control apparatus has a chute having a receiving end and a discharge end, and having a downward sloping lower surface for gravitationally moving ice from the receiving end to the discharge end. A door is movable with respect to the chute between an open position remote from the sloped lower surface of the chute to a closed position in proximity to the sloped lower surface of the chute at the discharge end of the chute. Ice is blocked on the sloped lower surface of the chute when the door is in the closed position.

Preferably, a door operator is connected to the door. The door operator has a door support with proximal and distal ends. The door is connected to the door support at a distal end. Pivot means is connected to a proximal end of the door support for pivoting the door support. Moving means is connected to the door support for moving the door support.

In one embodiment, the moving means is connected to the door support at a position spaced a relatively short distance from the proximal end and a relatively large distance from the distal end, for moving the door at a relatively high speed and over a relatively great distance with respect to movement of the moving means.

Alternatively, the moving means is connected to the door support at a position spaced a relatively short distance from the distal end, and a relatively large distance from the proximal end, for moving the door at a relatively high speed.

In the preferred embodiment, the moving means is connected to the door support at a position spaced a relatively short distance beyond the distal end of the support means, and a relatively large distance from the proximal end, for moving the door at a relatively high speed.

In one embodiment, a frame is mounted adjacent the chute near the receiving end. The pivot is connected to the frame above the receiving end of the chute, and the moving means is connected to the frame above the pivot. This frame extends below the chute. A drip collection pan connected to a lower end of the frame extends beneath a lower end of the sloping lower surface of the chute for collecting drips of melt water from ice held in the chute by the door.

In the preferred embodiment, the pivot is connected to the ice storage means above the receiving end of the chute, and the moving means is also connected to the ice storage means above the receiving end of the chute in a position adjacent to the pivot. A drip collection pan is connected to the ice storage means beneath the lower end of the sloping lower surface of the chute for collecting drips of melt water from ice held in the chute by the door.

In one embodiment, the door is a curved plate which is curved on a radius centered approximately at an upper portion of the receiving end of the chute.

Preferably, the door is a straight plate which abuts the discharge end of the chute.

A preferred method of controlling the dispensing of ice comprises storing ice, delivering stored ice to the receiving end of a chute, opening a door at a discharge end of a chute and flowing ice out of the discharge end of the chute, closing the door at the discharge end of the chute, and trapping ice in the chute.

The preferred method further comprises collecting water melted from ice held within the chute and conducting the melt water to a drip collection pan.

In the preferred method, the door opens upward and closes downward by supporting a door on an outward end of a door support and pivoting the door support on an inward end near an upper portion of the receiving end of the chute, linking the door support to an actuator near the pivoted end and lowering and lifting the actuator for raising and closing the door.

Preferably, the method of opening and closing of the door comprises moving the door in a single arcuate path.

These and further and other objects and features of the invention are apparent in the disclosure, which includes the above and ongoing written specification, with the claims and the drawings.

BRIEF DESCRIPTION OF THE DRAWINGS

FIG. 3 is a schematic representation of a cross-section of an ice storage bin with the preferred paddle wheel ice elevator delivering ice to a chute which is controlled by a door, and the door is opened and closed using a solenoid, two pulleys and cables.

FIG. 4 is a detailed view of the door and an another embodiment of the means to open and close this door.

DETAILED DESCRIPTION OF THE DRAWINGS

Figure 1:
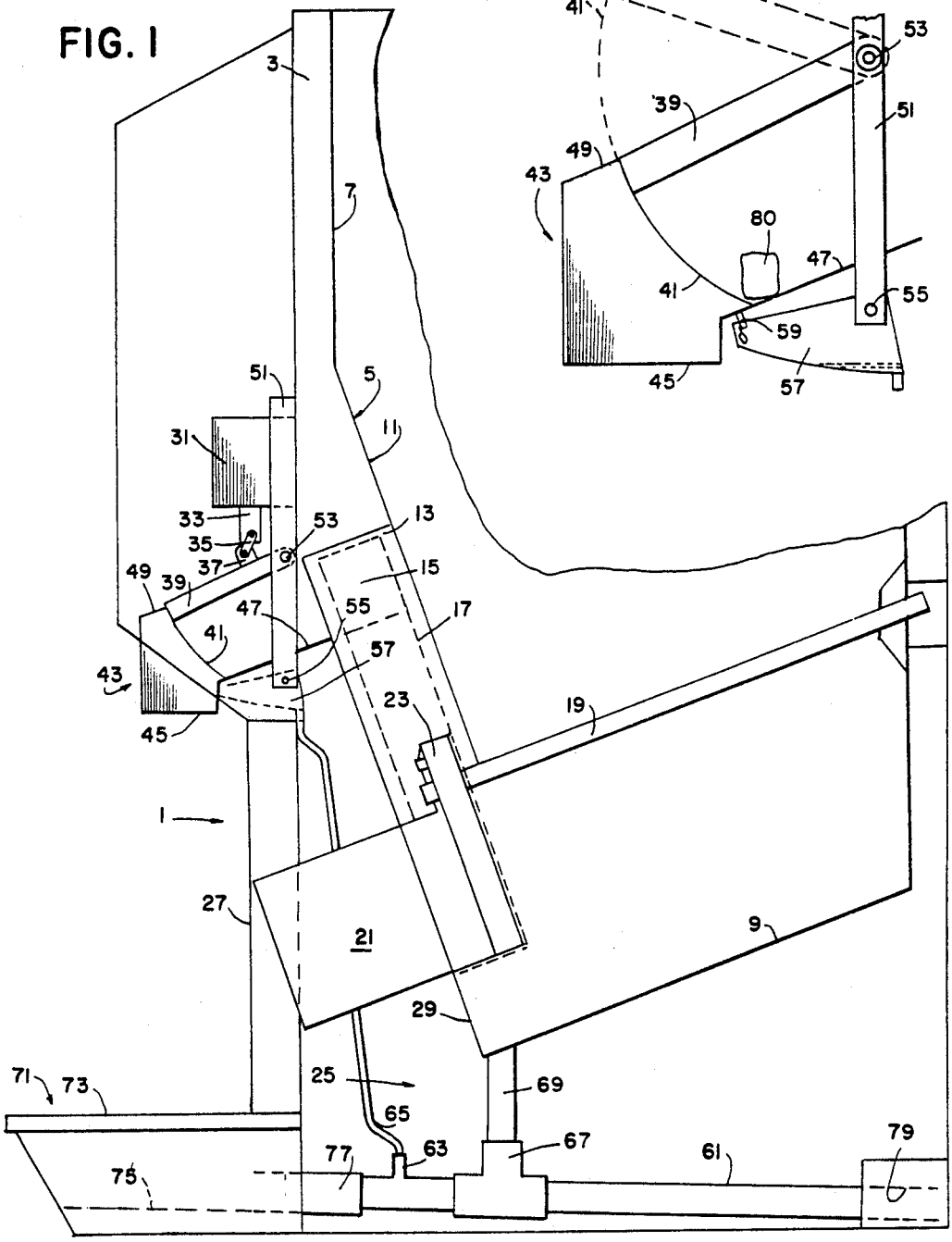
FIG. 1 is a schematic representation of a cross-section of an ice storage bin with a preferred paddle wheel ice elevator delivering ice to a chute, which is controlled by a door of the present invention.

Referring to FIG. 1, an ice dispenser is generally indicated by the numeral 1. An insulated wall 3 generally surrounds a storage bin 5. The storage bin 5 has a vertical upper portion 7 of a forward wall. A lower wall 9 is sloped downward and rearwardly to attempt to move ice toward the lower sloped portion 11 of the front wall. A recess 13 in the lower portion of the front wall receives paddles 15 mounted on a paddle wheel 17.

The paddle wheel is in turn mounted on a shaft 19. The shaft 19, which drives the paddle wheel 17, extends rearward to a bearing in the rear wall. One or more angled arms may extend from the shaft 19 within the bin to break up ice jams. Shaft 19 and paddle wheel 17 are driven by the gears 23 attached to an integrated electric motor and gear combination 21. The motor 21 and gears 23 are mounted within a recess 25 formed in the lower portion of the front of the cabinet by virtue of the inward sloping of the lower portion 11 of the storage bin front wall, which provides sufficient volume to receive the motor 21 and gears 23 in a space between the outer facing 27 of the cup receiving area and the outer wall 29 of the storage bin. The particular motor and gear combinations positioning allows ease of access by simply removing the facing 27 from the cup receiving area.

A shown in FIG. 1, the present invention may have a vertically mounted solenoid 31 on the outside of the insulated wall 3. Solenoid 31 operates a piston 33 which moves a link 35 and lug 37 to lift and lower plate 39. An arcuate door 41 is attached to the plate 39 for selectively opening and closing the chute 43. The chute, generally indicated by the number 43, has an opening 45 positioned directly above a container which is intended to receive ice.

As shown in FIG. 1, the lug 37 is near the pivot point 53 of the door mounting plate 39, so that small rapid movements of the solenoid piston 33 move the door with rapid opening and closing movements. The curvature of the door 41 permits rapid movement through the ice, and the positioning of the door near the bottom of the sloping wall 47 of the chute 43 reduces in-flight ice.

FIGS. 3 and 4 show another embodiment of the door moving means, where the mounted solenoid 31 operates a piston 33, which moves a first cable 32, which is connected to a first pulley 34. This first pulley 34 is joined to a larger second pulley 35. A second cable 36 connects the door lug 37 to the second pulley. The lug 37 is attached near the distal end 38 of door plate 39.

Figure 5:
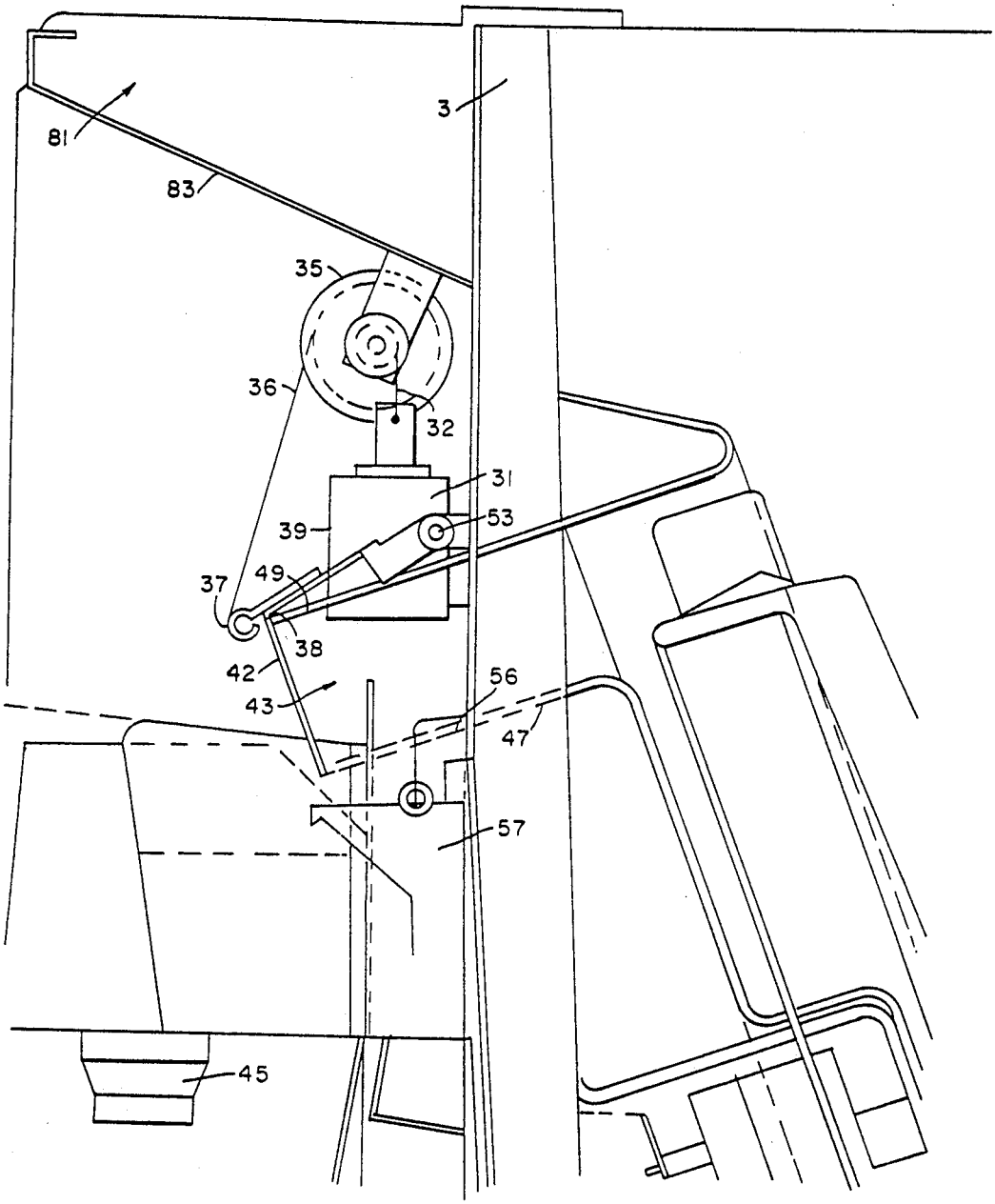
FIG. 5 is a side view of the preferred door and the preferred embodiment of the means to open and close this door.
Figure 6:
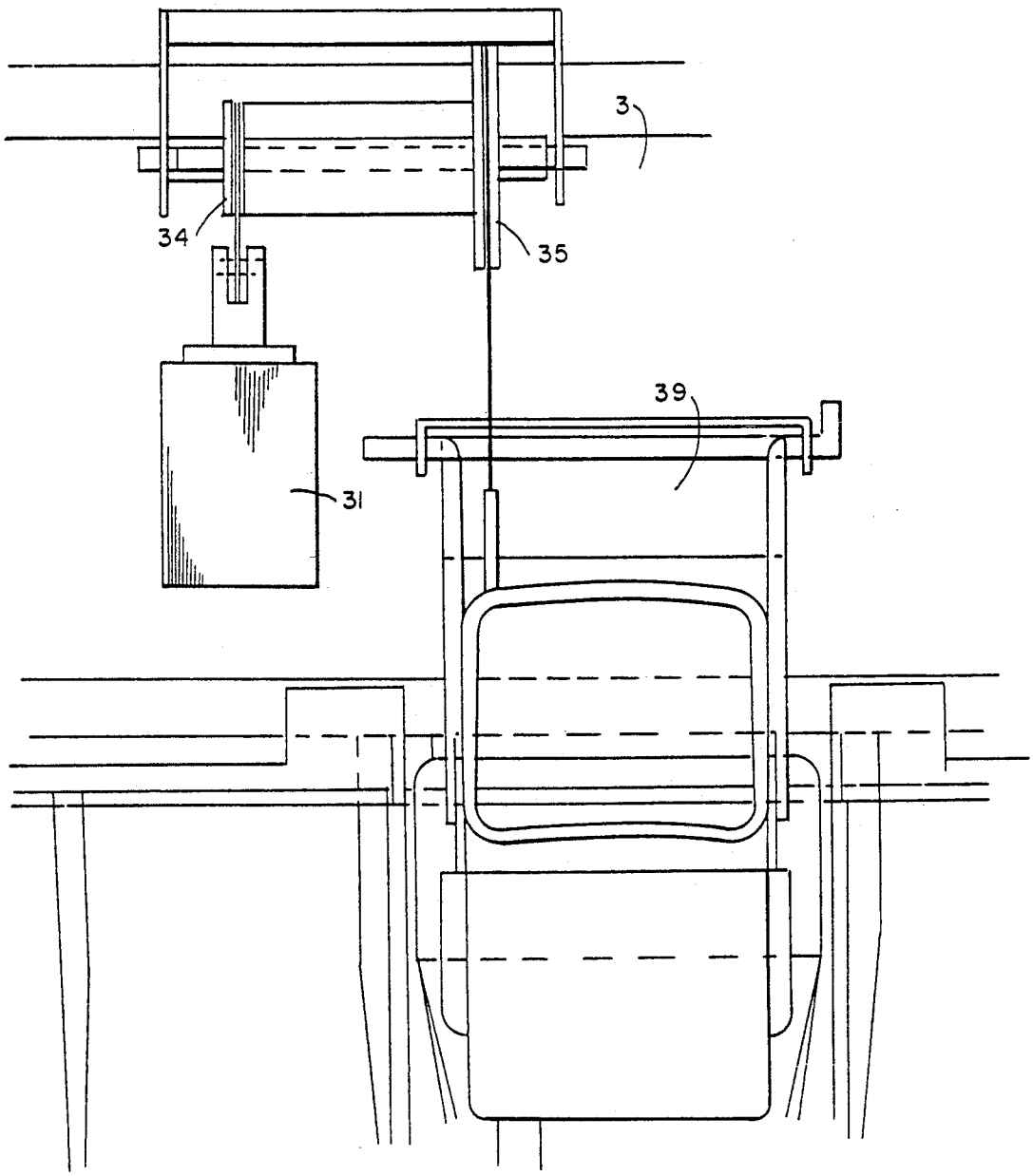
FIG. 6 is a front view of the preferred door and the preferred embodiment of the means to open and close this door.

The preferred embodiment, as shown in FIGS. 5 and 6, is a slight variation of the embodiment shown in FIGS. 3 and 4. As shown in FIG. 5, the preferred embodiment has the lug 37 attached to the door plate 39 so that it extends slightly beyond the distal end 38 of door plate 39. A straight door 42 is attached to the plate 39 for selectively opening and closing the chute 43.

The solenoid 31 is mounted on the outside of the insulated wall 3.

As illustrated in FIG. 6 the solenoid 31 is mounted to the insulated wall 3 at a similar location and adjacent to the pivot point of the door plate 39. FIG. 6 also illustrates the preferred embodiment of the joining of first pulley 34 to the larger second pulley 35. As can be seen from this figure, the first cable 32 from the smaller first pulley 34 connects to the solenoid 31 directly below the smaller pulley's circumference, so that only a vertical movement of the solenoid is necessary to open and close the door.

As shown in FIG. 5, the joined pulleys are connected to the sloping bottom 83 of the ice introduction means 81 of the present invention.

Also, as shown in FIG. 5, the first and second pulleys 34 and 35 are arranged much closer to the door. This allows for a more rapid opening and closing of the door since first and second cables 32, 36 are much shorter. In addition, the second cable 36 is connected to lug 37 and second pulley 35 at a greater angle than in the embodiment shown in FIG. 3.

This preferred embodiment of the door moving means solves the problem of premature wear on solenoids used in link-operated doors by reducing the lateral stress on the solenoids. This is achieved since the two joined pulleys are situated substantially above the door plate, and the cable from the smaller first pulley actually connects to a solenoid directly below the smaller pulley circumference, so that a vertical movement of the solenoid moves the door open and closed and lateral movement is eliminated.

The use of the joined pulleys allows the use of a solenoid with a $\frac{7}{8}$ inch stroke to open a door that travels $2\frac{5}{8}$ inches. The stroke length is important because most solenoids have a $\frac{7}{8}$ inch stroke or shorter. The present invention obtains the needed length through the joined pulleys without the lateral loads normally applied through lever advantages. Also, the preferred embodiment of the door moving means solves the problem of the pulling strength of a solenoid. The preferred embodiment uses the piston 33 of the solenoid 31 as a counterweight to offset the weight of the door. The use of the piston 33 allows the present invention to use a smaller or possibly a standard solenoid.

The door of the ice dispenser is the item that is normally the weak point. It can open as much as 1,000 times per meal, or 2,000–3,000 per day. Over a one year period, the door could see a million cycles of operation. The present invention provides a door with distinct advantages over the prior art doors and provides an apparatus which is able to withstand these cycles of operation without the usual prior art problems.

A switch, which is not shown, energizes solenoid 31 to open arcuate door 41 or straight door 42 and turns on motor 21 to drive the paddle wheel 17. Ice is delivered to the chute 43 and falls through opening 45 into the container. The switch may be a conventional lever positioned near facing 27 behind the container for contact by the container to start the motor and energize the solenoid, or the switch may be a push button switch located at a different position. The push button switch may be times to provide power to the motor 21 and energize the solenoid 31 for a predetermined period of time which is related to a predetermined amount of ice. Alternatively, the switch may be a coin-control switch which is operated for a predetermined period of time to provide a predetermined amount of ice in response to the deposit of a known amount of money.

As the paddle wheel 17 is driven, paddles 15 deliver ice to the upper end of the chute 43, and ice slides down the lower wall 47. The upper wall 49 of the chute has an opening through which door 41 or 42 and its pivoted support plate 39 may move.

The entire door operating apparatus of FIGS. 1 and 3 are mounted on a frame 51 connected to the wall of the ice storage bin 3. The door plate 39 is pivoted on pivot 53, which is at the center of curvature of door 41.

In the preferred embodiment as shown in FIG. 5, the solenoid and pivot 53 are attached to the insulated wall 3. The door plate 39 is pivoted on pivot 53. The first and second pulleys are mounted on the bottom 83 of the ice introduction means 81.

The door 41 or 42 may return to its closed state by gravitational force upon deactivation of solenoid 31, or solenoid 31 may be double acting to drive the door downward into the closed position by electromotive force or spring force. Preferably the current is removed from the solenoid when the door is closed.

Figure 2:
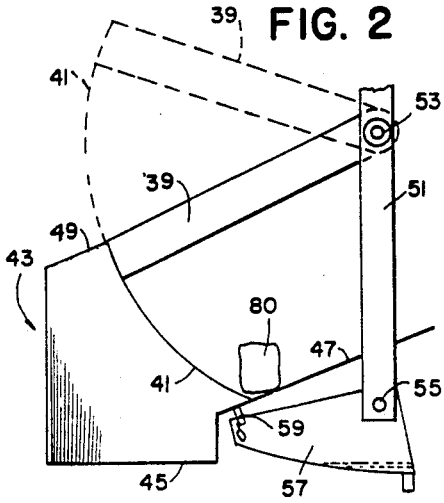
FIG. 2 is a detail of the chute, door and door drip pan of the present invention.

As best seen in FIG. 2, the arcuate door 41 pivots upwardly on plate 39 above the top 49 of the chute 43 when the door is open.

Because ice is trapped in back of the arcuate door 41 or the straight door 42 when it is closed, and because that ice 80 is outside of the insulated area of the storage bin, the ice may tend to melt over extended periods between dispensing operations.

As shown in FIG. 2, to catch that melt, a fastener 55 at the bottom of frame 51 holds a drip pan 57, which collects the melt water from the ice 80 in chute 43. The melt water drips down along the lower wall 47 of the chute, and drip ledge 59 causes the water to fall into the drip pan 57. That water flows into the main drain 61 through T 63 and tube 65. T 67 is connected to line 69, which drains the lower end of the front wall beneath the paddle wheel 17 (FIGS. 1 and 3).

As illustrated in FIG. 5, a fastener 56 attaches to the insulated wall 3 near the bottom of the chute 43 and pivotally connects the drip pan 57, which collects the melt water from the ice in chute 43. The melt water drips down along the lower wall 47 of chute 43 and falls into the drip pan 57.

As shown in FIG. 1, the container receiving pan 71 has a screen 73 for supporting the container, and a drip pan 75 which is connected with connectors 77 to the main drain 61. Connector 79 provides a connection to a hose for permanent fitting to a collection drain.

The drip pan 57 solves the new problem of ice which is held in the chute outside of the insulation of the storage bin.

While the invention has been described with reference to specific embodiments, modifications and variations of the invention may be constructed without departing from the scope of the invention, which is described in the following claims.

I claim:

1. Ice dispensing apparatus comprising ice storage means for storing ice, a sloped delivery chute along which ice slides connected to the ice storage means, means for moving ice from the storage means to the delivery chute, and a door connected to the delivery chute for moving through ice and stopping and holding ice in the delivery chute and for controlling the flow of ice out of the delivery chute, wherein the door is operated by a solenoid mounted above the delivery chute; the solenoid having a movable armature, the movable armature connected to the door through a connection means, a door mounting plate having proximal and distal ends, pivot means for connecting the proximal end of the door mounting plate, a lug connected to the door mounting plate for connecting to the movable armature by said connection means, wherein said door is connected to the distal end of the door mounting plate and extends therefrom into a block arrangement with respect to the chute, and being movable with the plate from a chute blocking condition to a chute opening condition, and wherein the door has a curvature centered on the pivot means and whereby a curved surface of the door moves within a circular arc about the pivot means in response to movements of the movable armature.

2. The apparatus of claim 1, wherein the connection means further comprises a first cable extending upwards away from the movable armature and connecting a first pulley to the movable armature, a second pulley which is joined to the first pulley, a second cable extending downward from the second pulley towards the delivery chute and connecting with the lug.

3. The apparatus of claim 1, further comprising the lug being connected to the door mounting plate at the distal end of the door mounting plate and extending beyond the door mounting plate for connecting with the connection means.

4. The apparatus of claim 1, wherein the door moves in an arc perpendicular to the chute and the chute lies in a radial direction with respect to the arc of the door movement.

5. The apparatus of claim 1, wherein the connection means further comprises an extension on the movable armature extending towards the delivery chute, a link connected to the end of the extension distally from the solenoid, said link further connected to the lug.

6. The apparatus of claim 5, further comprising the lug being connected to the door mounting plate near the proximal end of the door mounting plate.

7. Ice dispensing apparatus comprising ice storage means for storing ice, a sloped delivery chute along which ice slides connected to the ice storage means, means for moving ice from the storage means to the delivery chute, and a door connected to the delivery chute for moving through ice and stopping and holding ice in the delivery chute and for controlling the flow of ice out of the delivery chute, wherein the door is operated by a solenoid mounted above the delivery chute; the solenoid having a movable armature, the movable armature connected to the door through a connection means, a door mounting plate having proximal and distal ends, pivot means for connecting the proximal end of the door mounting plate, a lug connected to the door mounting plate for connecting to the movable armature by said connection means, wherein said door is connected to the distal end of the door mounting plate and extends therefrom into a blocking arrangement with respect to the chute, and being movable with the plate from a chute blocking condition to a chute opening condition, and wherein the door has a curvature centered on the pivot means and whereby a curved surface of the door moves within a circular arc about the pivot means in response to movements of the movable armature, further comprising the chute having a bottom end opposite the ice storage means connection, wherein the chute slopes downward from the connection to the bottom end; the door having a plate connection end connected at the distal end of the door mounting plate and an opposite chute abutment end with the curved surface provided therebetween, the chute abutment end of the door abutting the chute proximal the bottom end for reducing in-flight ice dispensing.

8. An ice dispensing apparatus comprising an ice storage means for storing ice, a sloped delivery chute along which ice slides connected to the ice storage means, means for moving ice from the storage means to the delivery chute, a door connected to the delivery chute for moving through ice and stopping and holding ice in the delivery chute and for controlling and flowing the ice out of the delivery chute, a vertically extending frame mounted on the ice storage means adjacent the chute, and wherein the door comprises a door mounting plate having distal and proximal ends, a pivot means is connected to a medial portion of the frame for connection with the proximal end of the door mounting plate, the door connected at the distal end of the door mounting plate wherein the door moves in an arc prescribed by the pivot means for covering and opening a chute opening, a moving means connected to the frame above the chute, and a connection means between the moving means and the door mounting plate for pivoting the door around the pivot means.

9. The apparatus of claim 8, wherein the moving means comprises a solenoid connected to an upper portion of the frame.

10. The apparatus of claim 9, wherein the connection means further comprises an armature extending downward from the solenoid for connection with a link, a lug connected to the door mounting plate and also connected to the link.

11. The apparatus of claim 10, wherein the lug is mounted on the door mounting plate at a position closer to the proximal end than the distal end, wherein the door moves at a speed greater than the armature and over a greater distance than the armature.

12. The apparatus of claim 9, wherein the connection means further comprises an armature extending upwards from the solenoid, a first cable extending upwards away from the delivery chute and connecting a first pulley to the movable armature, a second pulley which is joined to the first pulley, a second cable extending downward from the second pulley toward the delivery chute, a lug mounted on the door mounting plate for connection with the second cable, wherein the door is connected to the distal end of the door mounting plate and extends therefrom into a blocking arrangement with respect to the chute, and being movable with the plate from the chute blocking position to a chute opening position.

13. The apparatus of claim 12, wherein the second pulley larger than the first pulley.

14. The apparatus of claim 12, wherein the lug is mounted on the door mounting plate at a position closer to the distal end than the proximal end, wherein the door moves at a speed greater than the armature and over a distance greater than the armature.

15. The apparatus of claim 12, wherein the solenoid is positioned directly below the first pulley's circumference, so that only vertical movement of the solenoid moves the door mounting plate open and closed.

16. The apparatus of claim 8, further comprising a drip collection means connected to a lower end of the frame, whereby melt water from ice held in the chute by the door is collected by the drip collection means.

17. The apparatus of claim 16, wherein the drip collection means comprises a collection pan mounted beneath the chute whereby the chute drips water from the melting ice held behind the door and the collection pan collects water dripping from the chute.

18. The apparatus of claim 17, further comprising a ledge connected to a bottom of the chute external of the door and lower than the door, whereby the ledge drips water from melting ice held behind the door and the collection pan collects water dripping from the ledge.

19. The apparatus of claim 17, further comprising conduit means connected to the pan and to a drain for draining water from the pan.

20. An ice dispensing apparatus comprising an ice storage means for storing ice, a sloped delivery chute along which ice slides connected to the ice storage means, means for moving ice from the storage means to the delivery chute, a door connected to the delivery chute for moving through ice and stopping and holding ice in the delivery chute and for controlling and flowing the ice out of the delivery chute, a vertically extending frame mounted on the ice storage means adjacent the chute, and wherein the door comprises a door mounting plate having distal and proximal ends, a pivot means is connected to a medial portion of the frame for connection with the proximal end of the door mounting plate, the door connected at the distal end of the door mounting plate wherein the door moves in an arc prescribed by the pivot means for covering and opening a chute opening, a moving means connected to the frame above the chute, and a connection means between the moving means and the door mounting plate for pivoting the door around the pivot means, wherein the door is connected to the distal end of the door mounting plate and oppositely abuts a bottom end of the chute in a blocking arrangement with respect to the chute.

21. Ice dispensing apparatus comprising ice storage means for storing ice, a sloped delivery chute along which ice slides connected to the ice storage means, a pivot means provided proximal the chute for pivoting a door mounting plate, the door mounting plate having a proximal end connected to the pivot means and a distal end connected to a door which extends in a blocking arrangement with respect to the chute; a solenoid having a movable armature, a cable and pulley arrangement oppositely connecting the movable armature of the solenoid to a lug attached to the door mounting plate for imparting movement therebetween, whereby actuation of the solenoid raises or lowers the door in the blocking arrangement with respect to the chute for dispensing ice from the chute.

22. The apparatus of claim 21, wherein the solenoid is mounted on the ice dispensing apparatus above the chute with the armature extending vertically upwards, wherein the pulley apparatus is mounted above the solenoid and a first cable end attaches to the armature, and a second cable end attaches to the lug with the pulley apparatus interposed intermediately.

23. A cable operated ice dispensing door, comprising a delivery chute connected to an ice storage means and sloping downward and outward from the ice storage means towards an open delivery end, a pivot means provided above the chute proximal the connection between the chute and the ice storage means for pivoting a door mounting plate, the door mounting plate having a proximal end attached to the pivot and a distal end, wherein a door connects at the distal end and is rotatable around the pivot in a blocking arrangement with the open chute end, a solenoid having a movable armature, a lug connected to the plate, a cable apparatus provided between the lug and the armature for translating movement in the armature to the lug, wherein at least one cable attaches to the armature and oppositely to the lug, wherein the door is opened for an upward impartation of the lug by the cable and is closed by an opposite movement of the armature which allows the door to fall due to gravity and close the chute said movement being effected by a movable means connect between the armature and the lug.

24. The apparatus of claim 23, wherein the movable means is a pulley apparatus provided in conjunction with the cable for translating movement between the armature and the lug.

25. The apparatus of claim 24, further comprising the movable armature extending vertically upwards from the solenoid with the pulley apparatus provided thereabove, wherein a downward movement of the armature connected to the cable apparatus translates into an upward movement of the door plate due to the translation of the pulley apparatus.

26. A method for dispensing ice comprising mounting a dispensing chute on an ice storage means, angling the chute downwards and away from the storage means to a chute opening, providing a pivot means proximal the connection between the chute and the storage means for pivoting a door mounting plate, attaching a door to the door mounting plate so the door extends downwards from the plate and covers the chute opening in a blocking arrangement, mounting a solenoid on the storage means, providing a movable armature on the solenoid and a cable connection means on the plate, and positioning a cable and pulley arrangement between the cable connection means and the movable armature for translating movement from the armature to the door to open and close the door with respect to the chute opening.

27. The method of claim 28, further comprising positioning the pulley apparatus above the plate with the armature extending vertically upwards from the solenoid towards the pulley apparatus and connecting at least one cable oppositely to the connection means and the armature.

* * * * *